US005390742A

United States Patent [19]

Dines et al.

[11] Patent Number: 5,390,742

[45] Date of Patent: Feb. 21, 1995

[54] INTERNALLY SEALABLE PERFORABLE NIPPLE FOR DOWNHOLE WELL APPLICATIONS

[75] Inventors: Christopher A. Dines, Dallas; Clark E. Robison, Plano; Perry C. Shy, Arlington; William R. Welch, Carrollton, all of Tex.

[73] Assignee: Halliburton Company, Houston, Tex.

[21] Appl. No.: 39,851

[22] Filed: Mar. 30, 1993

Related U.S. Application Data

[63] Continuation-in-part of Ser. No. 950,456, Sep. 24, 1992.

[51] Int. Cl.[6] ..... E21B 33/13; E21B 43/12

[52] U.S. Cl. ..... 166/297; 166/55.1; 166/242; 166/277; 166/332; 166/386; 166/387

[58] Field of Search ..... 166/242, 332, 318, 373, 166/386, 316, 277, 297, 55.1, 285, 387

[56] References Cited

U.S. PATENT DOCUMENTS

| | | | |
|---|---|---|---|
| 3,057,295 | 10/1962 | Christopher | 175/4.6 |
| 3,067,819 | 12/1962 | Gore | 166/277 X |
| 3,073,392 | 1/1963 | Dinning et al. | 166/332 |
| 3,115,187 | 12/1963 | Brown | 166/316 |
| 3,354,955 | 11/1967 | Berry | 166/277 |
| 3,364,993 | 1/1968 | Skipper | 166/277 X |
| 3,465,836 | 9/1969 | Fields | 166/55.1 X |
| 3,468,386 | 9/1969 | Johnson | 166/100 X |
| 3,542,130 | 11/1970 | Stout | 166/318 |
| 3,583,481 | 6/1971 | Vernotzy | 166/184 |
| 3,606,584 | 9/1971 | Sizer | 166/313 |
| 3,669,190 | 6/1972 | Sizer et al. | 166/315 |
| 3,746,091 | 7/1973 | Owen et al. | 166/277 X |
| 3,789,923 | 2/1974 | Garrett | 166/55.1 |
| 3,910,349 | 10/1975 | Brown et al. | 166/153 |
| 4,220,206 | 9/1980 | Van Winkle | 166/318 |
| 4,278,131 | 7/1981 | Jani | 166/332 |
| 4,299,287 | 11/1981 | Vann et al. | 166/297 |
| 4,450,912 | 5/1984 | Callihan et al. | 166/289 |
| 4,673,039 | 6/1987 | Mohaupt . | |
| 4,880,059 | 11/1989 | Brandell et al. | 166/332 |
| 4,915,175 | 4/1990 | Mashaw, Jr. | 166/332 |
| 4,949,788 | 8/1990 | Szarka et al. | 166/285 |
| 5,012,867 | 5/1991 | Kilgore | 166/188 |
| 5,025,861 | 6/1991 | Huber et al. | 166/297 |
| 5,070,943 | 12/1991 | Walker et al. | 166/297 |
| 5,156,213 | 10/1992 | George et al. | 175/4.52 X |

FOREIGN PATENT DOCUMENTS 2240798 8/1991 United Kingdom .

OTHER PUBLICATIONS

"New system speeds multiple zone horizontal completions", Pike, Wm. J., Ocean Industry, Mar., 1992; pp. 42–44.

*Primary Examiner*—Hoang C. Dang

*Attorney, Agent, or Firm*—Tracy W. Druce; J. Richard Konneker

[57] ABSTRACT

A longitudinally spaced series of tubular nipple structures are installed in a well flow conductor operatively extended through a subterranean well bore. Each nipple structure has a thinned-wall, increased interior diameter longitudinal section through which a plurality of fluid flow openings laterally extend, and an interior side surface annular tool locator recess, with each such recess having a profile different than those of all of the other tool locator recesses. The thinned-wall longitudinal sections of the nipples facilitate the formation of the flow openings therein. To seal off the flow openings in any selected one of these longitudinal nipple sections, a radially expandable tubular metal patch is supported on a setting tool which is lowered into the well flow conductor. A locator member complementarily and lockably receivable by the locator recess of the selected nipple is also supported on the tool. When the locator member snaps into releasably locked engagement with such locator recess, the patch member is automatically positioned in a predetermined longitudinal orientation coaxially with the longitudinal nipple section whose flow openings are to be sealed off. An expander portion of the setting tool is then pulled through the patch member to radially expand it into sealing engagement with the interior side surface of the selected longitudinal nipple section. Due to the increased interior diameter of the longitudinal nipple section, the tubular patch member installed therein does not decrease the drift diameter of the well flow conductor.

18 Claims, 5 Drawing Sheets

INTERNALLY SEALABLE PERFORABLE NIPPLE FOR DOWNHOLE WELL APPLICATIONS

CROSS-REFERENCE TO RELATED APPLICATION

This application is a continuation-in-part of U.S. application Ser. No. 07/950,456, filed on Sep. 24, 1992 and entitled "DEDICATED PERFORATABLE NIPPLE WITH INTEGRAL ISOLATION SLEEVE."

BACKGROUND OF THE INVENTION

This invention relates generally to apparatus and methods for completing downhole wells, and more particularly relates to flow conductors for conveying inflowing formation fluid in water, oil, gas and recovery wells.

In the course of completing an oil and/or gas well, it is common practice to run a string of protective casing or liner into the well bore and then to run production tubing inside the casing. The annulus between the liner or casing and the surrounding formation is sealed with a deposit of cement to prevent fluid flow through the external annulus from one formation zone to another. The cement is pumped through a work string suspended within the casing or liner into the annular space between the liner or casing and the surrounding well bore.

If the lining or casing traverses a hydrocarbon-bearing formation, the lining is perforated to create flow apertures through the casing and cement so that the formation fluids can flow into the well. The liner and/or well casing is perforated by a perforating gun which is suspended within the well. Shaped explosive charges carried by the gun blast openings through the metal lining, the cement deposit and the surrounding formation.

In some completions, however, the well bore is uncased, and an open face is established across the oil or gas bearing zone. Uncased arrangements of this type may be utilized, for example, in water wells, test wells and horizontal/deviated well completions. In one form of such uncased completions, a relatively small diameter flow conductor is suspended within the uncased bore hole and cement is pumped through the flow conductor into the annulus between the flow conductor and the surrounding earth formation. After cement residue is cleaned from the flow conductor, the flow conductor and the surrounding cement deposit are perforated to admit formation fluid into the well.

Because of the economies associated with this type of uncased completion, there is a continuing interest in improving the flow conductors used in such completions. There is a need in such completions for a small diameter nipple, incorporated in the well flow conductor, which can be used in vertical as well as deviated uncased well bores, and reliably perforated by a small diameter perforating gun. There is also a need for apparatus and methods for closing off the flow openings in a small diameter nipple of the type described. It is accordingly an object of the present invention to provide such a nipple and associated flow opening closure apparatus and methods.

SUMMARY OF THE INVENTION

In carrying out principles of the present invention, in accordance with a preferred embodiment thereof, a specially configured tubular nipple structure is provided that may be coaxially placed in a subterranean well flow conductor, and positioned therein to extend through a subsurface fluid production zone. In a representative well completion, a longitudinally spaced plurality of the nipples are used, each nipple extending through a subsurface fluid production zone.

Each nipple has an increased interior diameter along a longitudinal section thereof. Accordingly, the wall thickness of this longitudinal section is reduced relative to the balance of the nipple. Such wall thickness reduction in the longitudinal nipple section substantially facilitates its perforability.

Interiorly formed in a non-thinned-wall section of each nipple structure is an annular tool locator member receiving profile. The contour of each such profile may be different than those of all of the other profiles.

The thinned-wall section of each nipple may have flow openings formed therethrough either before or after the nipple is operatively positioned within a production zone portion of the well bore. When the nipple flow openings are formed after subsurface placement of the nipples, for example by a shaped charge perforation gun, the gun structure may have mounted thereon one of an interchangeable series of radially expandable locator members each configured to be removably and lockingly received in a selected one of the interior nipple profiles. Accordingly, the perforation gun can be very precisely located at any selected one of the thinned-wall nipple sections without the necessity of electromagnetically sensing and counting piping joints (a process commonly referred to as "collar logging") as the perforation gun is lowered into place through the flow conductor.

According to a primary aspect of the present invention, any longitudinal portion of the thinned-wall nipple section may be subsequently sealed using an expandable sealing member, preferably in the form of a conventional, radially expandable tubular metal patch member lowered into the thinned-wall nipple section on a conventional patch-setting tool. Precise location of the tool (and thus the expandable patch member carried thereon) within the flow conductor is achieved by appropriately mounting on the setting tool structure a radially expandable locator member similar to that described above in conjunction with the perforation gun.

Thus, by appropriately selecting the locator member carried by the patch-setting tool, the expandable patch member may be precisely positioned within the perforated thinned-wall nipple section to be sealed, without the necessity of electromagnetically sensing and counting piping joints as the setting tool structure is lowered into place through the flow-conductor.

After the patch member is lowered into place within the perforated thinned-wall nipple section, an expander portion of the setting tool is pulled upwardly through the patch member (and subsequently out of the flow conductor) in a conventional manner to radially expand the patch into sealing engagement with the interior side surface of the thinned-wall nipple section.

Importantly, since the cylindrical patch is installed within an enlarged internal diameter section of the nipple, the interior diameter of such nipple section may be appropriately correlated with the installed inner diameter of the patch in a manner such that the installed patch member does not reduce the "drift" (i.e., the minimum interior diameter) of the flow conductor. Stated in another manner, because the installed patch is received in a radially enlarged interior "pocket" portion of the nipple structure, the interior side surface of the installed patch member does not radially encroach inwardly beyond the diametrical periphery of the balance of the nipple structure.

DETAILED DESCRIPTION

Figure 1:
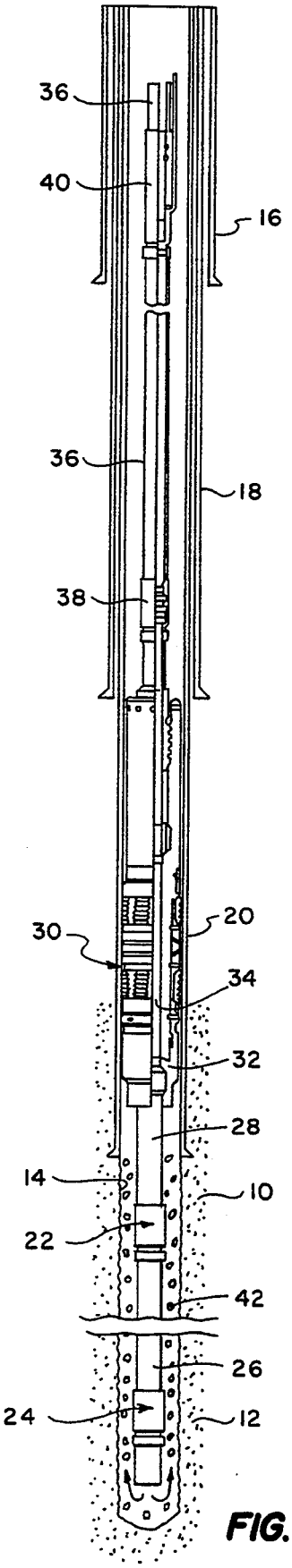
FIG. 1 is a simplified schematic diagram showing a vertical section through two producing formations which are intersected by an uncased well bore which has been completed with two production nipples suspended from a retrievable packer.

In the description which follows, like parts are indicated throughout the specification and drawings with the same reference numerals, respectively. The drawings are not necessarily to scale and the proportions of certain parts have been exaggerated to better illustrate details of the invention.

Referring now to FIG. 1, a first hydrocarbon formation 10 and a second hydrocarbon formation 12 are intersected by an uncased well bore 14. The uncased well bore 14 is sealed from the surface by a primary casing string 16, having an 11 inch diameter, which is secured to the wellhead assembly. Intermediate zones of the uncased well bore 14 are isolated by an intermediate casing string 18, having a 7 $\frac{5}{8}$ inch diameter, and a final casing string 20, having a 5 $\frac{1}{2}$ inch casing diameter.

The well 14 is completed by multiple nipple sections 22,24 which are connected by a threaded union T in flow communication by flow conductors 26,28. The flow conductor 28 is suspended from a retrievable packer 30 which is releasably set in engagement against the bore of the lowermost casing 20. The retrievable production packer 30 includes a mandrel 32 having a longitudinal production bore 34 for conveying formation fluid to the surface. The packer mandrel bore is coupled in fluid communication with a string of 3 $\frac{1}{2}$ inch production tubing 36 by a full bore landing nipple 38. Production flow through the production tubing string 36 is controlled by a tubing retrievable safety valve 40.

Before the production tubing 36 is installed in the full bore landing nipple 38, a work string is coupled to the landing nipple and a predetermined volume of cement is pumped through the packer bore, the flow conductors 26,28 and the production nipples 22,24. The annulus surrounding the suspended flow conductors and production nipples is filled with a cement deposit 42 which prevents vertical flow of formation fluid between the hydrocarbon formation 10 and the hydrocarbon formation 12. A seal plug is introduced into the bore of the work string to separate the cement from the displacing fluid and to wipe the cement from the packer bore, the flow conductor bores and the nipple bores as the cement is displaced out of the tubing and into the surrounding annular space.

After the seal plug has been removed and the production bores have been cleared of debris, a perforating gun 44 is positioned within the bore of each nipple. The perforating gun 44 is suspended and run into the well on a tubing string. Preferably, the tubing string is a length of coil tubing having a firing line inside. The perforating gun assembly 44 is equipped with a mandrel 46 which includes an array of explosive, jet-type perforating charges 48. The perforating gun 44 is coupled to the flow conductor 28 by a locator sub 50.

Upon detonation, each explosive charge 48 produces a high temperature, high pressure plasma jet 52 which penetrates the sidewall of the nipple 22, the protective cement layer 42 and the surrounding formation 12. The high temperature, high pressure plasma jet 52 penetrates the metal sidewall of the nipple, thus producing a clean perforation 54 through the surrounding concrete layer and earth formation. Preferably, the shoot is performed with the well in an underbalanced pressure condition relative to the surrounding formation. With a sufficiently high pressure differential, the pressure surge from the surrounding formation will break up any compacted material and sweep it back in the well bore where it will be flowed to the surface. As compacted fragments are swept away, the nipple sidewall perforations 54 are cleaned and cleared for maximum inflow. After the perforating gun 44 is removed from the well, the well is then ready for immediate production.

Figure 3:
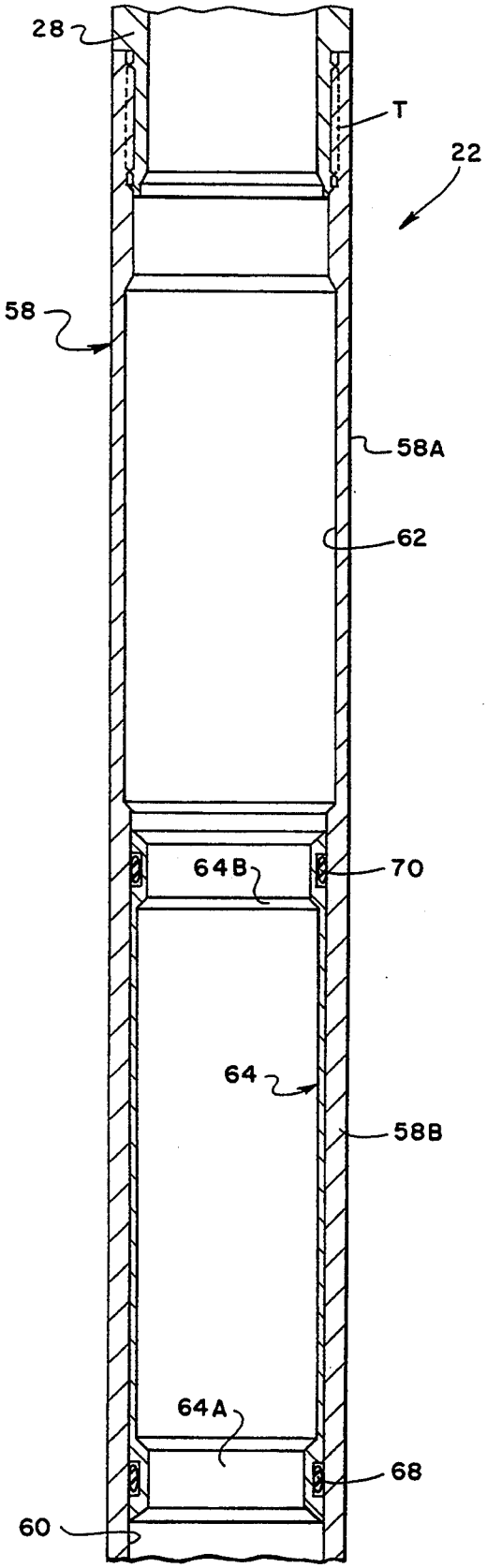
FIG. 3 is a longitudinal sectional view of the production nipple of FIG. 1 showing the isolation sleeve in its uncovered position with the dedicated section of the production nipple being exposed for perforation.
Figure 4:
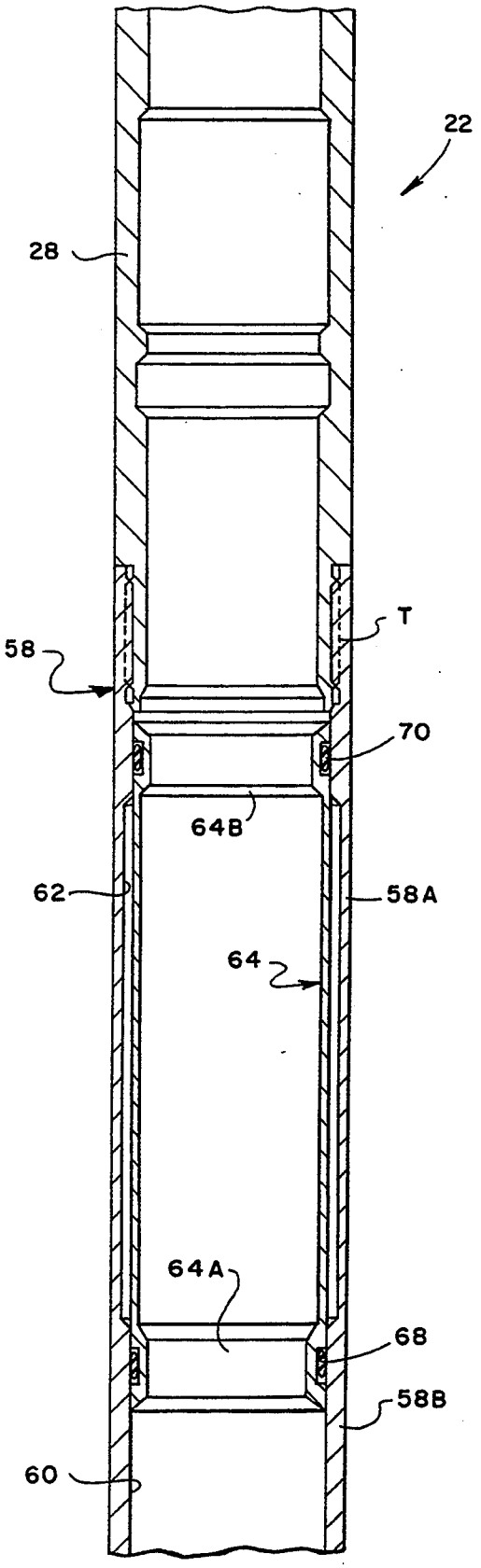
FIG. 4 is a view similar to FIG. 3 in which the isolation sleeve is in its covered position in which the dedicated sidewall of the production nipple is sealed.

Referring now to FIGS. 3 and 4, the production nipple 22 includes a tubular mandrel 58 which includes first and second longitudinally spaced sidewall sections 58A,58B. According to one aspect of the present invention, one of the mandrel sidewall sections, in this instance section 58A, is dedicated for perforation by a perforating gun, and is characterized by a lower resistance to perforation in response to the explosive force of a shaped charge as compared to the perforation resistance of the other sidewall section 58B. The differential resistance to perforation is obtained, according to one aspect of the present invention, by forming the dedicated sidewall section 58A with a reduced radial thickness as compared to the sidewall thickness of the nipple section 58B.

The mandrel section 58B is intersected by a longitudinal production bore 60, and the dedicated sidewall section 58A is intersected by a longitudinal counterbore 62 which extends along the length of the dedicated sidewall section 58A. According to this arrangement, the main production bore 60 is enlarged by the counterbore 62 along the length of the dedicated sidewall section. The radial thickness of the dedicated sidewall section 58A is reduced substantially with respect to the thickness of the nipple sidewall section 58B, as shown in FIG. 4o In those installations where the nipples support very little hang weight, the radial thickness of the dedicated sidewall section 58A can be reduced substantially relative to the thickness of the nipple sidewall section 58B.

Figure 2:
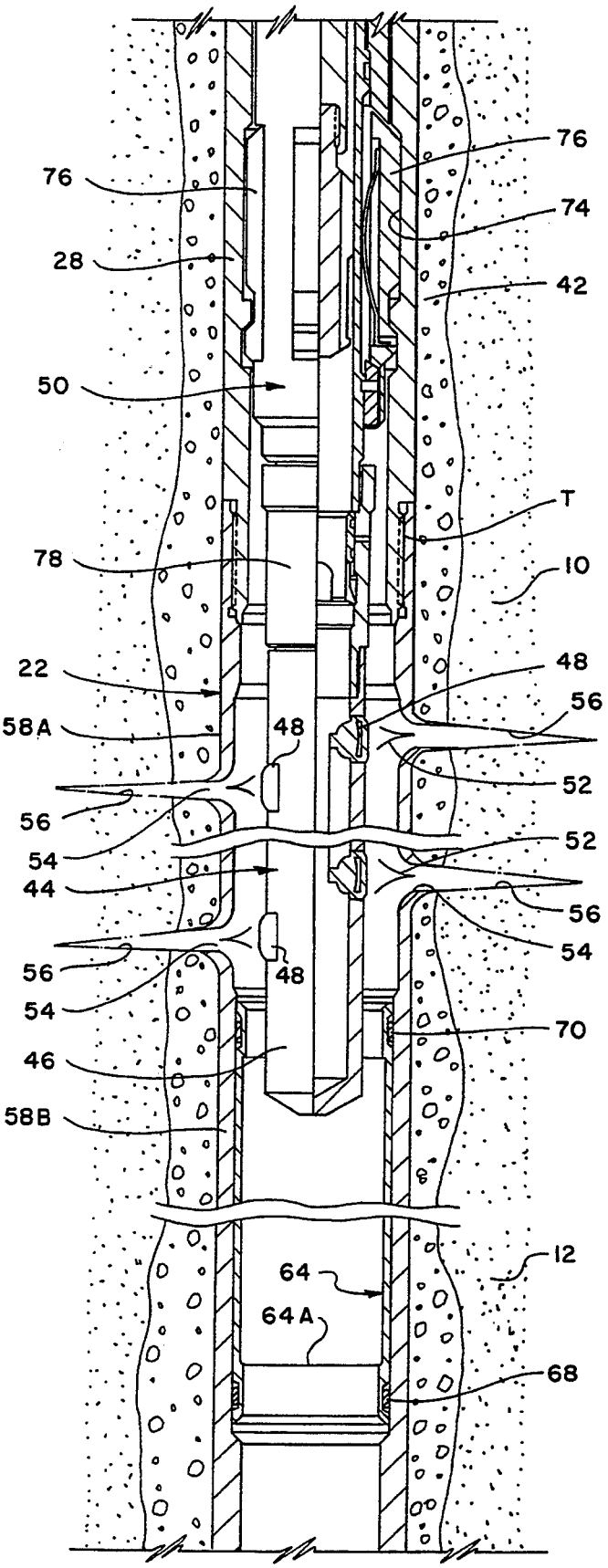
FIG. 2 is a simplified, sectional view which illustrates perforation of the production nipple, cement deposit and formation in a slimhole/monobore completion.

According to another aspect of the present invention, an isolation sleeve 64 is incorporated within the production nipple 22 for the purpose of selectively isolating a particular production zone at any time during the life of the well. That is, the isolation sleeve 64 is shifted to a non-Interfering position, as shown in FIG. 2, in which the dedicated sidewall section 58A is exposed to the perforating gun 44. The isolation sleeve 64 is also movable to a closed position, as shown in FIG. 4, in which the perforated, dedicated sidewall section is sealed for the purpose of isolating the zone which may be producing an excessive amount of gas or water.

The isolation sleeve 64 is received in slidable, sealing engagement against the production bore 60 of the nipple mandrel. The isolation sleeve 64 is provided with shifting shoulders 64A,64B which are engageable by a shifting tool supported on a wire line or by a coiled tubing string. Although the exemplary embodiment shows that the dedicated nipple sidewall section 58A is arranged for exposure by downshifting the isolation sleeve 64, it will be appreciated that the respective positions of the dedicated nipple section 58A and nipple section 58B could be reversed, with the isolation sleeve 64 being shifted upwardly for exposure of the dedicated sidewall section.

As can best be seen in FIG. 4, the isolation sleeve 64 spans the complete length of the dedicated sidewall section 58A, with the counterbore 62 being sealed with respect to the production bore 60 by first and second annular seal members 68 and 70, respectively. The annular seal members 68,70 are curved, molded seals which are carried in annular slots formed in the shifting shoulders 66A and 66B, respectively.

Figure 5:
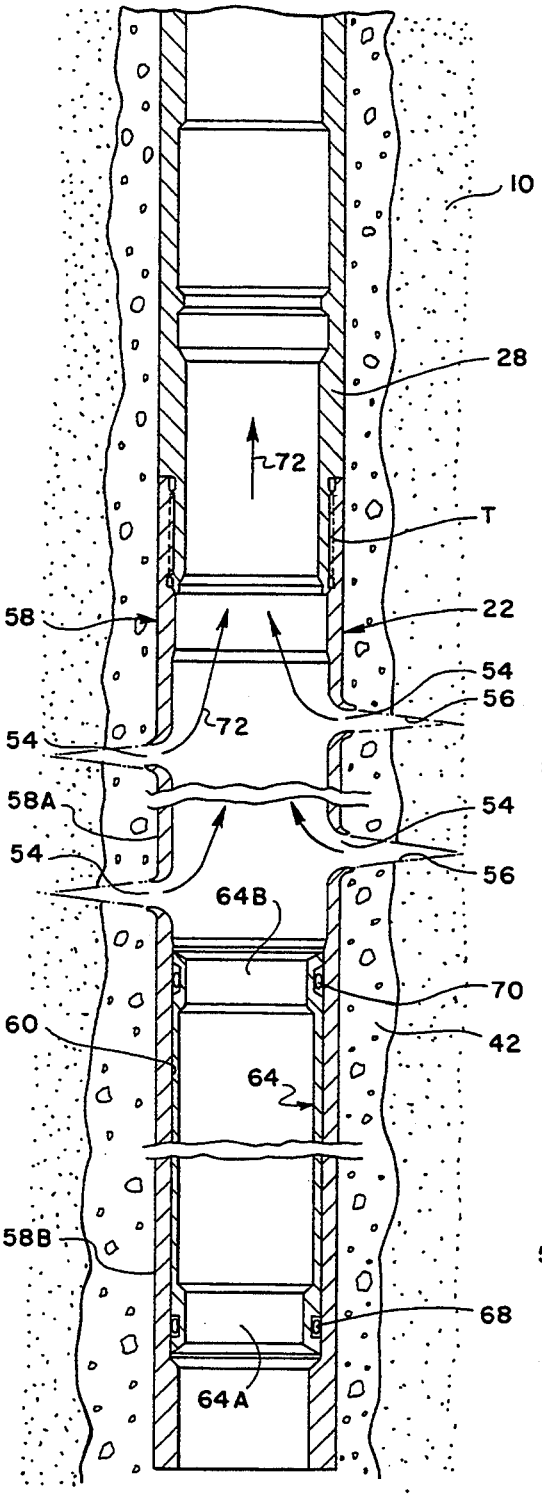
FIG. 5 is a longitudinal sectional view of the slimhole/monobore completion showing the production of formation fluid through the perforated nipple.
Figure 6:
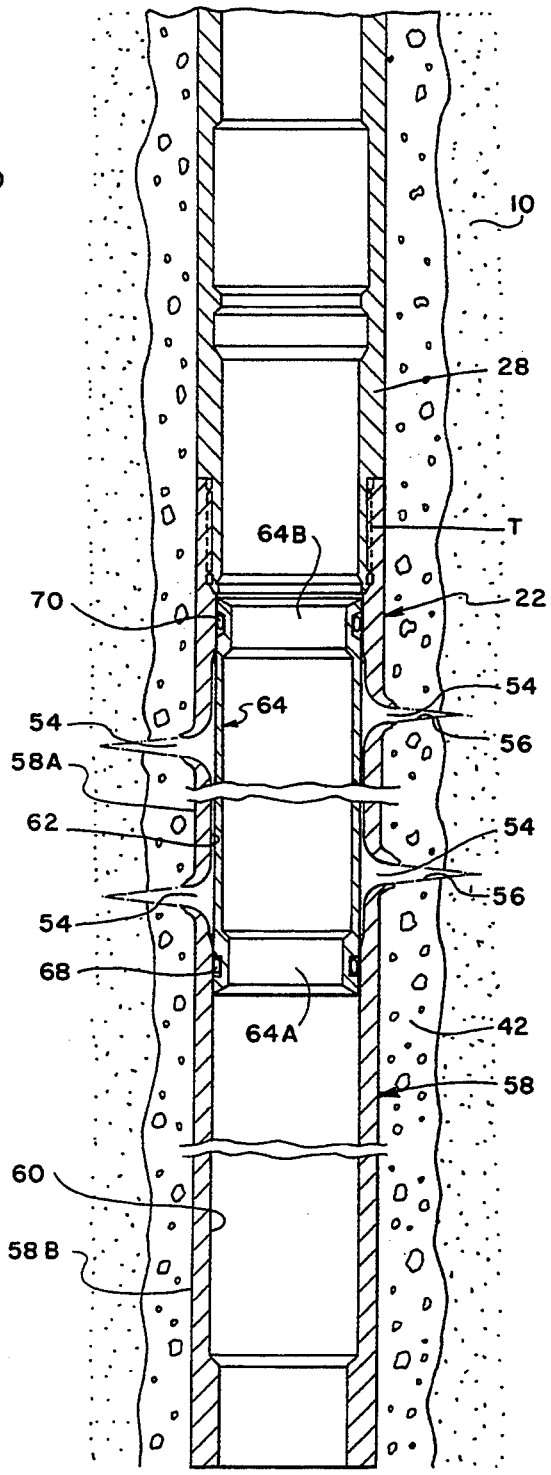
FIG. 6 is a view similar to FIG. 3 in which fluid flow through the production nipple has been terminated by an isolation sleeve.

Referring to FIG. 5, the isolation sleeve 64 is received within the production bore 60 of the nipple mandrel 58 in a non-interfering position in which the dedicated sidewall section 58A of the nipple is uncovered, thus permitting the flow of formation fluid through the nipple perforations 56, as indicated by the arrows 72. As shown in FIG. 6, the dedicated section 58A is completely covered by the isolation sleeve 04, and the counterbore 62 is sealed by the annular seals 68 and 70, thus preventing the inflow of formation fluid through the nipple perforations 56.

In some installations, the flow conductor 28 is suspended directly from the wellhead, with one or more production nipples 22,24 being suspended within the uncased well bore, typically in a shallow slimhole/-monobore well completion. In such installations, the perforating gun 44 may be located accurately when the depth of the production nipple is known. The operator runs the perforating tool until the length of the coiled tubing corresponds with the known depth of the production nipple. However, that method becomes less accurate for deep wells, in particular for wells which may have lateral deviations.

Referring now to FIG. 2, accurate positioning of the perforating gun 44 is provided by an annular locator slot 74 formed on the flow conductor 28, and a resilient, deflectable latch arm 76 carried on the locator sub 50. The resilient, deflectable arm 76 is movable from a retracted, non-interfering position which permits travel of the perforating gun 44 through the production bore, to a radially extended, latched position, as shown in FIG. 2, in which it is received within the locator slot 74. According to this arrangement, the perforating gun 44 is located precisely in shoot alignment with the dedicated sidewall section 58A of the production nipple 22. The longitudinal distance of the dedicated nipple sidewall section 58A relative to the locator slot 74 is known, and the length of the perforating gun 46 relative to the latch arm 76 is adjusted with a coupling sub 78 so that the explosive charges 48 are centered in shoot alignment along the length of the dedicated nipple sidewall section 58A when the latch arm 76 is received in detented engagement with the locator slot 74.

Figure 7:
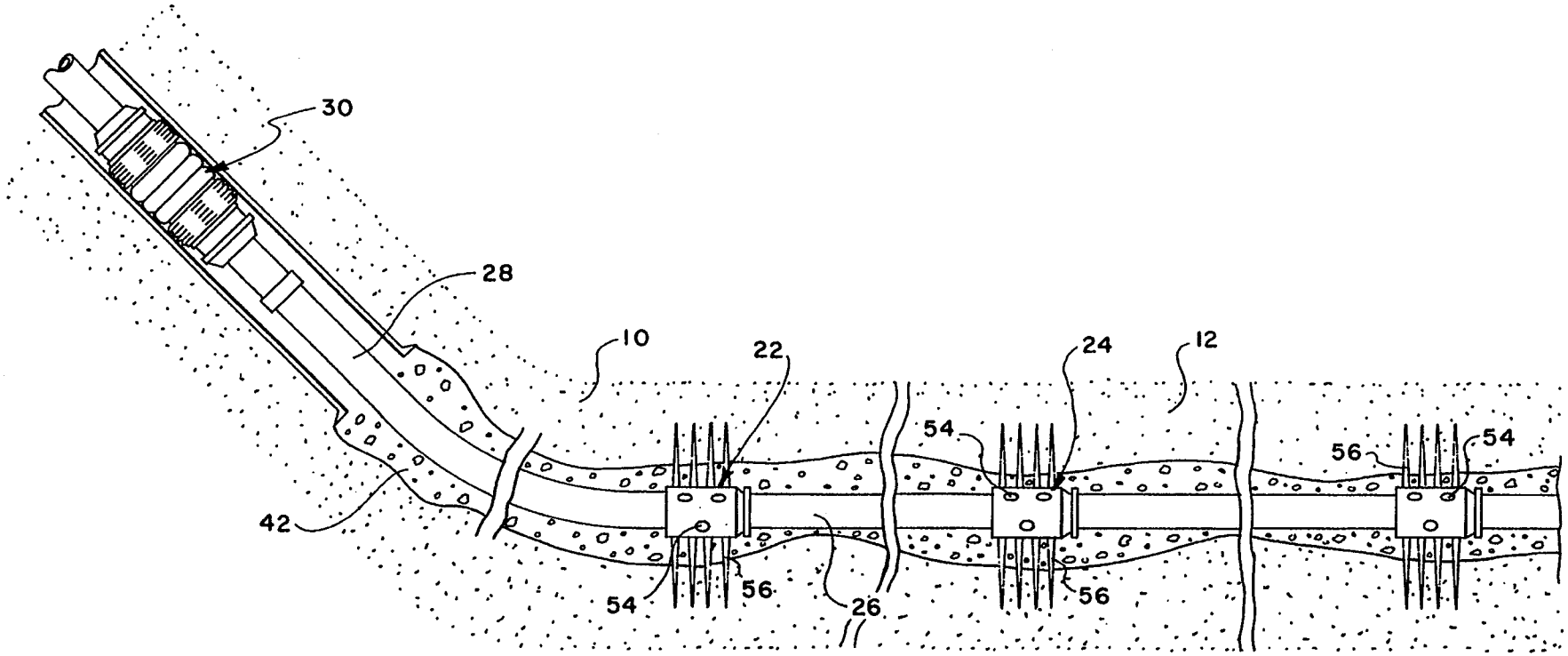
FIG. 7 is a simplified, sectional view which illustrates a horizontal well completion in an uncased bore hole in which multiple production nipples are positioned in registration with multiple producing zones.

It will be appreciated that because of the reduced radial thickness of the dedicated nipple sidewall section 58A, reliable puncture and penetration through the nipple 22, cement deposit 42 and earth formation 10 can be obtained with a smaller, less powerful explosive charge. Since a less powerful explosive charge is required, the perforating gun 46 can be physically smaller in diameter, and can be run through the small diameter production tubing (3 ½ inch or smaller) utilized in slimhole/monobore completions. Because of the reduced sizing provided by the production nipple of the present invention, the well may be drilled with a smaller rig, less well control material is required during drilling of the bore hole, the quantity of cement required is reduced, and the size and quantity of casing and tubing required to complete the well are reduced. Moreover, the well may be completed on coiled tubing, thus further reducing the cost of the completion string and reducing the overall time required for installation. Since coiled tubing may be utilized, the well may be completed or recompleted without the necessity of killing the well, thereby reducing the potential for damage to the reservoir. Moreover, in multizone completions, the production nipples may be opened and closed as desired, either sequentially or selectively, for isolating a zone which may be producing too much water or gas. The production nipples of the present invention may also be used in uncased, horizontal completions as shown in FIG. 7.

Figures 8, 9, 9A, 9B, 10:
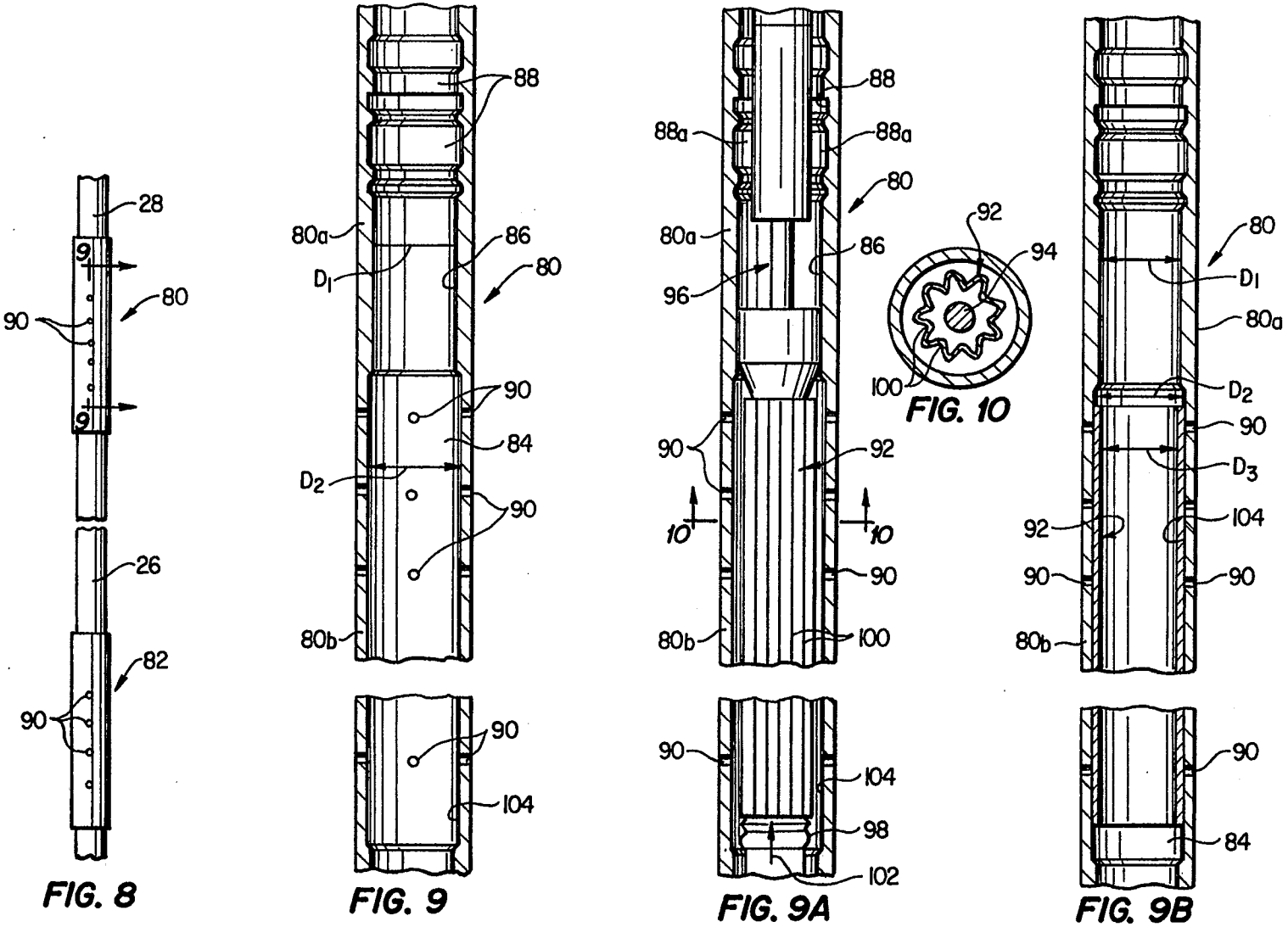
FIG. 8 is a longitudinally foreshortened, highly schematic side elevational view of a portion of the well completion in which two alternatively configured nipples are operatively connected.
FIG. 9 is an enlarged scale partial cross-sectional view, taken along line 9—9, through one of the FIG. 8 nipples.
FIG. 9A is a cross-sectional view similar to that in FIG. 9 and schematically illustrating a setting tool being used to axially position an expandable tubular patch member in a thinned-wall, increased interior diameter longitudinal section of the FIG. 9 nipple.
FIG. 9B is a cross-sectional view similar to that in FIG. 9A, but With the setting tool removed and the tubular patch operatively expanded into internally sealing contact with the thinned-wall section of the alternatively configured nipple.
FIG. 10 is a slightly enlarged scale cross-sectional view through the alternatively configured nipple taken along line 10—10 of FIG. 9A.

Schematically depicted in FIG. 8 are a pair of alternatively configured nipples 80 and 82 which are representatively connected in the well flow conductor structure 26, 28 in place of the previously described nipples 22,24 shown in FIG. 1. With one exception discussed below, nipple 80 has a configuration identical to that of nipple 82 and is cross-sectionally illustrated in FIG. 9.

As shown in FIG. 9, the body of nipple 80 has a generally tubular configuration, and an upper longitudinal section 80a with an interior diameter $D_1$ which, for purposes of illustration, will be assumed to be the minimum "drift" diameter of the well flow conductor in which the nipples 80,82 are installed. Extending downwardly from the longitudinal section 80*a* of the tubular nipple body is a thinned-wall, increased interior diameter lower longitudinal section 80*b* having, along its length, an interior diameter $D_2$ greater than the upper longitudinal section diameter $D_1$. Longitudinal section 80*b* is representatively of a unitary construction, but may alternatively be formed from several connected longitudinal segments of thinned-wall pipe.

This differential between diameters $D_1$ and $D_2$ creates within longitudinal nipple section 80*b* an annular interior side surface pocket area 84 that projects radially outwardly beyond the interior side surface 86 of longitudinal section 80*a*. The diameter differential also substantially reduces the wall thickness of longitudinal section 80*b* relative to that of longitudinal section 80*a*. In turn, this substantially facilitates the side wall perforability of longitudinal section 80*b*.

Coaxially formed in the interior side surface 86 of longitudinal section 80*a* is an annular tool locator member recess 88 similar to annular locator slot 74 in the previously described nipple 22. Annular recess 88 is configured to complementarily and lockingly receive locator members (such as the members 76 shown in FIG. 2) carried on a perforating gun lowered into the flow conductor to the selected nipple. As previously described in conjunction with the nipple 22, the perforating gun, precisely located in a shooting position within the longitudinal nipple section 80*b* by the receipt of the locator members in the recess 88, may be used to form the illustrated flow openings 90 in the thinned-wall longitudinal section 80*b*.

Alternatively, the annular recess 88 may be formed in a portion of the well flow conductor axially adjacent the nipple structure. Since the nipple structures 80,82 define portions of the overall well flow conductor, a reference herein to forming an annular locator recess within the well conductor includes either the formation of the recess within a nipple structure proper, or within the balance of the well flow conductor (such as the tubular portions 26 and 28 shown in FIG. 1) connected between the nipple structures.

According to a feature of the present invention, each locator recess 88 in the nipples 80,82 (as well as any others of this nipple embodiment incorporated in and defining a portion of the well flow conductor) preferably has a profile different than those of all the other locator member recesses formed in the nipples. Accordingly, by mounting on the perforating gun tool locator members configured to be complementarily received in only a selected one of the annular recesses 88, the perforating gun (as shown in FIG. 2) may be precisely located in any selected one of the longitudinal nipple sections 80*b* without the necessity of electromagnetically sensing and counting piping joints (a process commonly referred to as "collar logging"), as the gun is lowered through the well flow conductor, in order to place the gun at the desired depth in the well flow conductor. Alternatively, the annular locator recesses could have identical profiles.

In comparing the nipple 80 to the previously described nipple 22 it will be noted that the nipple 80 is not provided with a slidable, internal isolation sleeve (such as the previously described sleeve 64) for use in internally sealing off the side wall flow openings 90 of the nipple 80. Accordingly, the length of the longitudinal nipple section 80*b* in which such openings are formed may be considerably greater than the section 58A of nipple 22 since the length of section 80*b* of nipple 80 is not limited by the weight and/or sliding frictional forces of a movable closure sleeve carried therein.

More specifically, whether the well flow conductor in which previously described nipples 22,24 are incorporated is vertical, horizontal, or at some deviation angle therebetween, the maximum length of the slidable isolation sleeve 64 is determined by the maximum permissible shifting forces that may be exerted on the sleeve. The sleeve shifting force required is, of, course directly proportional to the length of the sleeve 64 which, in turn, is directly proportional to its length. Thus, the maximum length of the perforated nipple section which can be sealed off by the slidable sleeve is limited by the maximum permissible length of the sleeve itself (about ten feet). Since this limitation is absent in the alternate embodiment 80 of the nipple 22, the length of the perforable nipple section 80*b* may be considerably longer than ten feet. Representatively, this advantageously permits each of the nipple sections 80*b* to be several hundred feet in length if desired.

While the nipples 80,82 are representatively illustrated in vertical orientations, it will be appreciated that they could also be incorporated in horizontal or otherwise deviated well flow conductors if desired. Additionally, while the flow openings 90 have been described as being formed (using a perforating gun) after the nipples have been operatively positioned within the well bore, the openings 90 could be formed in other manners prior to the positioning of the nipples 80,82 in the well bore. Moreover, when the flow openings are formed prior to the subterranean installation of the nipples 80,82 other shapes and types of flow openings (for example, slots) could be utilized if desired. Instead of perforating the thinned wall of the longitudinal nipple section 80*b* to form the radial flow openings in the overall nipple structure 80, such flow openings could also be defined by the multiplicity of small openings in a suitable permeable porous flow member, such as a sintered screen member, axially interposed in and forming an axial portion of the nipple 80.

Flow openings 90 have been representatively illustrated as being inlet openings for admitting production fluid into the interiors of the nipples 80 and 82, the illustrated nipples 80,82 thereby being "production" nipples. However, it will be readily appreciated that these openings could also function as outlet flow openings in applications in which it is desired to flow fluid radially outwardly through the openings 90.

Turning now to FIGS. 9A and 10, the flow openings 90 in the installed nipple 80 may be subsequently sealed off, from within the nipple 80, using an expandable sealing member, preferably in the form of a conventional, radially expandable tubular metal sealing patch 92 coaxially supported around a shaft portion 94 of a conventional setting tool 96 which may be lowered through the well flow conductor and has an axially movable expander portion 98 carried on the lower end of the shaft 94 beneath the bottom end of the tubular patch 92.

As in the case of the previously described perforating gun, the setting tool 96 carries thereon radially expandable locator members 88a which are selected from an interchangeable set of locator members (or "keys") having different profiles each configured to be complementarily and lockingly received radially in the annular recess 88 of only one of the nipples 80,82 (in this case nipple 80). Accordingly, by appropriately selecting the profile of the locator members 88*a* secured to the setting tool 96, as the setting tool is lowered through the well flow conductor it automatically locks into place at the selected nipple to precisely position the expandable patch member 92 within the longitudinal section 80*b* of the selected nipple without the necessity of electromagnetically sensing and counting piping joints to appropriately position the tool within the well flow conductor.

As illustrated in FIGS. 9A and 10, the tubular patch member 92 in its ready-to-use configuration has a circumferentially spaced series of longitudinal corrugations 100 serving to reduce the outer diameter of the patch member to a magnitude less than that of the drift diameter $D_1$, thereby permitting the patch member 92 to be lowered through the well flow conductor into the target nipple section 80*b*. Once this is done, the expander 98 is forcibly moved upwardly through the patch member 92, as indicated by the arrow 102 in FIG. 9A. This forcibly expands the patch member 92, in a radially outward direction, into forcible sealing engagement with the interior side surface 104 of the nipple section 80*b* over the flow openings 90 therein. The setting tool 96 is then upwardly withdrawn from the nipple 80 leaving the now operatively expanded tubular patch 92 permanently in place within the longitudinal section 80*b* of nipple 80 as shown in FIG. 9B.

According to a key aspect of the present invention best illustrated in FIG. 9B, the interior side surface diameter $D_2$ of the longitudinal nipple section 80*b* is correlated with the wall thickness of the tubular patch member 92 in a manner such that when the patch member 92 is operatively expanded into the annular side surface pocket 84 as shown in FIG. 9B the interior diameter $D_3$ of the expanded patch member is not less than the drift diameter $D_2$. This advantageously maintains the previous minimum drift diameter of the overall well flow conductor and thus does not reduce the maximum radial size of apparatus that may be passed axially through the patched nipple 80. Accordingly, if desired, the flow openings 90 in the nipple 82 (or other nipples below the now sealed nipple 80) may be subsequently sealed using another tubular patch member lowered through the nipple 80.

The tubular patch member 90 has been representatively illustrated in FIG. 9A as being of sufficient length to interiorly seal off all of the flow openings 90 in the longitudinal section 80*b* of the nipple 80. However, if desired, a shorter patch member could be used to seal off only some of such openings.

While the interior sealing of the perforated nipple section 80*b* has representatively been illustrated using a tubular metal patch member installed by a setting tool which carries the patch down the flow conductor, other types of tubular sealing members could be placed in the perforated section 80*b* and then operatively expanded into place therein using other types of expansion means if desired.

The foregoing detailed description is to be clearly understood as being given by way of illustration and example only, the spirit and scope of the present invention being limited solely by the appended claims.

What is claimed is:

1. A subterranean well completion comprising:

a subterranean well bore;

a tubular well flow conductor extending through said well bore and having coaxially installed therein a tubular nipple extending along an axis, said nipple having a radially enlarged annular interior side surface pocket area formed in a longitudinal section of said nipple through which flow openings radially extend; and a tubular sealing member coaxially and nonmovably disposed within said longitudinal section, said tubular sealing member being in forcible, radially outwardly directed contact with the interior side surface of said longitudinal section and sealing off said flow openings, said nipple having a minimum interior diameter less than the interior side surface diameter of said pocket area, and said tubular sealing member having an interior diameter generally equal to or greater than said minimum interior diameter of said nipple.

2. The nipple of claim 1 wherein said nipple is a production nipple and said flow openings are inlet flow openings.

3. The subterranean well completion of claim 1 further comprising:

an annular interior side surface recess coaxially formed in said well flow conductor, longitudinally outwardly of said pocket area, and configured to complementarily receive a locator member carried by a tool axially inserted into said nipple.

4. The subterranean well completion of claim 3 wherein said annular recess is formed in said nipple.

5. The subterranean well completion of claim 3 wherein:

said annular recess is configured to complementarily receive a locator member supporting a perforating gun.

6. The subterranean well completion of claim 3 wherein:

said annular recess is configured to complementarily receive a locator member supporting a patch-setting tool.

7. The subterranean well completion of claim 1 wherein said sealing member comprises a tubular metal patch portion.

8. A method of constructing and operating a subterranean well completion, said method comprising the steps of:

forming a subterranean well bore;

operatively positioning a tubular well flow conductor in said well bore, said well flow conductor having, along its length, a minimum interior drift diameter, and further having coaxially installed therein a nipple structure with a tubular body portion, said tubular body portion having a thinned-wall, increased interior diameter longitudinal section, the interior diameter of which is greater than said drift diameter, said longitudinal section having a flow opening extending laterally therethrough;

permitting a fluid to flow through said flow opening; and sealing off said flow opening by the steps of:

disposing sealing means within said longitudinal section after said well flow conductor is operatively positioned within said well bore, and installing said sealing means in intimate sealing contact with the interior side surface portion of said longitudinal section through which said flow opening extends, said installing step being performed in a manner such that the installed sealing means do not reduce said interior drift diameter of said well flow conductor.

9. The method of claim 8 wherein:

said disposing step is performed by lowering a sealing member into said longitudinal nipple structure longitudinal section through said well bore, and said installing step is performed by radially forcing said sealing member into intimate sealing contact with the interior side surface portion of said longitudinal section through which said flow opening extends.

10. The method of claim 9 wherein said disposing and installing steps are performed by:

coaxially disposing a radially expandable tubular sealing member within said longitudinal section, and radially expanding said sealing member into forcible sealing engagement with the interior side surface of said longitudinal section over said flow opening, the wall thickness of said tubular sealing member and the interior diameter of said longitudinal section being correlated with one another in a manner such that the operatively installed tubular sealing member does not reduce said interior drift diameter of said well flow conductor.

11. The method of claim 8 wherein:

said flow opening is formed in said longitudinal section of said tubular body portion prior to positioning said nipple structure in said well bore.

12. The method of claim 8 further comprising the step of:

forming said flow opening with a perforating gun lowered into said nipple after said nipple is positioned within said well bore.

13. The method of claim 12 wherein said step of forming said flow opening includes the steps of:

coaxially forming an annular locator member recess in the interior side surface of said well flow conductor adjacent said longitudinal section of said tubular body portion, operatively associating a locator member with said perforating gun for movement therewith through said well flow conductor, and lowering said perforating gun through said well flow conductor, and causing said locator to complementarily enter said annular recess to precisely position said perforating gun within said longitudinal section.

14. The method of claim 13 wherein:

said step of coaxially forming includes the step of positioning said annular locator member recess within said tubular body portion.

15. The method of claim 8 wherein:

said step of coaxially disposing a radially expandable tubular sealing member within said longitudinal section is performed by the steps of:

forming an annular recess in said well flow conductor adjacent said longitudinal section, supporting said sealing meter and a locator member on a setting tool , and lowering said setting tool through said well flow conductor until said locator member is complementarily received in said annular recess, and said radially expanding step is performed using said setting tool.

16. The method of claim 15 wherein:

said step of forming an annular recess includes the step of positioning said annular recess within said nipple structure.

17. A subterranean well completion comprising:

a subterranean well bore; and a tubular well flow conductor structure having, along its length, a minimum interior drift diameter, said well flow conductor structure operatively extending through said well bore and including a longitudinally spaced plurality of generally tubular nipple structures each having a thinned-wall, increased interior diameter longitudinal section through which a plurality of flow openings laterally extend; and a longitudinally spaced plurality of annular tool locator member recesses coaxially formed in the interior side surface of said well flow conductor longitudinally outwardly of said thinned-wall, increased interior diameter longitudinal sections, each of said tool locator member recesses having a configuration different than the configuration of every other one of said tool locator member recesses, each of said thinned-wall, increased interior diameter longitudinal nipple sections being diametrically sized to permit a radially expandable tubular sealing member to be radially expanded into forcible sealing engagement with its interior side surface, over its flow openings, without a reduction in said interior drift diameter by the installed tubular sealing member.

18. A method of constructing and operating a subterranean well completion comprising the steps of:

forming a subterranean well bore;

extending a tubular well flow conductor structure through said well bore, said well flow conductor structure including a longitudinally spaced plurality of generally tubular nipple structures each having an annular interior side surface tool locator member recess and a thinned-wall, increased interior diameter longitudinal section through which a plurality of flow openings are formed, said well flow conductor structure having, along its length, an interior drift diameter, and said tool locator member recesses having mutually different configurations;

permitting subterranean fluid to flow inwardly through said flow openings; and sealing off the flow openings of a selected one of said nipple structures by the steps of:

supporting a radially expandable tubular patch member on a setting tool, supporting a locking structure on said setting tool, said locking structure being configured to be lockingly received only by the tool locator member recess of the selected one of said nipple structures, lowering said setting tool into said well flow conductor structure in a manner releasably engaging said locking structure with the tool locator member recess of the selected one of said nipple structures in a manner coaxially positioning said tubular patch member within the thinned-wall, increased interior diameter longitudinal section of the selected one of said nipple structures, using said setting tool to radially expand the lowered tubular patch member into forcible, interior sealing engagement with the thinned-wall, increased interior diameter longitudinal section of the selected one of said nipple structures, and correlating the tubular patch member wall thickness with the interior diameter of said longitudinal section of the selected nipple structure in a manner such that the operatively expanded tubular patch member does not reduce said interior drift diameter of said well flow conductor.

* * * * *